US009572384B2

(12) United States Patent
Tiffin

(10) Patent No.: US 9,572,384 B2
(45) Date of Patent: Feb. 21, 2017

(54) ILLUMINATED GLOVE ASSEMBLY

(71) Applicant: Mangata, LLC, Lewisburg, PA (US)

(72) Inventor: Mary Tiffin, Windfield, PA (US)

(73) Assignee: Mangata, LLC, Lewisburg, PA (US)

( * ) Notice: Subject to any disclaimer, the term of this patent is extended or adjusted under 35 U.S.C. 154(b) by 0 days.

(21) Appl. No.: 15/003,053

(22) Filed: Jan. 21, 2016

(65) Prior Publication Data

US 2016/0215970 A1 Jul. 28, 2016

Related U.S. Application Data

(60) Provisional application No. 62/107,007, filed on Jan. 23, 2015.

(51) Int. Cl.

| | |
|---|---|
| ***F21V 21/08*** | (2006.01) |
| ***A41D 19/015*** | (2006.01) |
| ***A41D 19/00*** | (2006.01) |
| ***A41D 27/20*** | (2006.01) |

(52) U.S. Cl.

CPC ..... *A41D 19/0157* (2013.01); *A41D 19/002* (2013.01); *A41D 19/01547* (2013.01); *A41D 27/205* (2013.01)

(58) Field of Classification Search

CPC ..... A41D 19/002; A41D 19/01547; A41D 19/0157; A41D 27/205; F21V 23/023; F21V 23/04; F21V 33/008

USPC ..... 362/103

See application file for complete search history.

(56) References Cited

U.S. PATENT DOCUMENTS

| | | | | |
|---|---|---|---|---|
| 3,638,011 | A | 1/1972 | Bain et al. | |
| 4,625,339 | A | 12/1986 | Peters | |
| 5,345,368 | A | 9/1994 | Huff | |
| 5,500,956 | A * | 3/1996 | Schulkin | A63B 71/148 2/159 |
| 5,535,105 | A | 7/1996 | Koenen et al. | |
| 5,580,154 | A | 12/1996 | Coulter et al. | |
| 5,816,676 | A | 10/1998 | Koenen Myers et al. | |
| 6,529,121 | B2 * | 3/2003 | Bush | A41D 19/0157 340/321 |
| 6,892,397 | B2 | 5/2005 | Raz et al. | |
| 7,013,490 | B2 | 3/2006 | Senter et al. | |
| 7,152,248 | B2 | 12/2006 | Ziemer | |
| 8,562,165 | B2 | 10/2013 | Thompson et al. | |
| 2009/0168407 | A1 * | 7/2009 | Wright | F21L 4/00 362/103 |
| 2011/0258752 | A1 | 10/2011 | Matheney, II et al. | |
| 2013/0265788 | A1 * | 10/2013 | O'Maley | F21L 4/00 362/103 |

* cited by examiner

*Primary Examiner* — Jason Moon Han
(74) *Attorney, Agent, or Firm* — Panitch Schwarze Belisario & Nadel LLP

(57) ABSTRACT

An illuminated glove assembly for providing illumination to a user, wherein the illuminated glove assembly has a glove with a hand portion and an illumination data controller. The hand portion includes a back portion, fingers, a wrist end and a palm portion. The back portion includes a first pocket with a first opening proximate the fingers and a first terminal end proximate the wrist end. The illumination data controller is configured for selective mounting in the first pocket. The illumination data controller has a housing with a front face, a top surface, a length, a width and a thickness. The front face includes a light source from which light emanates and the width is greater than the thickness.

18 Claims, 8 Drawing Sheets

ILLUMINATED GLOVE ASSEMBLY

CROSS-REFERENCE TO RELATED APPLICATIONS

The present application claims the benefit of U.S. Provisional Patent Application No. 62/107,007, filed on Jan. 23, 2015 and titled "Illuminated Running Gloves" the entire contents of which are incorporated herein by reference in their entirety.

BACKGROUND OF THE INVENTION

The preferred invention relates generally to illuminated gloves and, more particularly, to an illuminated gloves assembly that illuminates a wearer's path while worn when ambient light is minimal. The preferred illuminated gloves may be particularly adapted for runners, cyclists, athletes, outdoorsmen, survivalists, everyday use or for any situation where the user or wearer desires light projecting from their hands. The preferred glove assembly includes an illuminated data controller that provides illumination, sensors and wireless communication capabilities.

Gloves that provide a light source to allow a wearer to accomplish a variety of tasks are known. Generally, some such gloves are configured to have a reflective strip or a light diffuser that makes the wearer more visible in conditions where ambient light is poor, but do not provide sufficient light to aid the wearer's vision. Alternately, other gloves are configured to house a light source which illuminates the area immediately in front of the wearer's hand or fingers to aid in performing tasks that require the use of each of the wearer's fingers and/or hands, but similarly do not provide sufficient light to illuminate a great enough area to enable a runner to see more than a very short distance in front of him or her while ambient light is low. Known gloves are also configured to display particular symbols, are relatively cumbersome and lack other features that are desired by users for illuminating a desired area or accommodating various additional accessories while providing a low profile, comfortable and efficient operation and appearance. Such prior art gloves also lack a convenient way to remove and replace the light for use of the gloves without the light and to readily replace the battery associated with the light. These prior art gloves further lack storage pockets or storage features for retaining the wearers items, such as keys, currency, communication devices, energy packs, the light and other relatively modest sized personal items of the user.

Alternative prior art illumination devices also include flashlights or headlamps that must be carried consistently by hand or require the user to turn their head to project the light in desired directions, respectively. Prior art vests may also incorporate lights or lights may be clipped onto a user's clothing, but such lights are also difficult to direct without awkward body movements and such light may be lost and misplaced. Further, flashlights or other handheld lights require occupation of one of the user's hands, thereby reducing the ability of the user to use their occupied hand to complete desired tasks.

It is therefore, desirable to design, develop, manufacture and distribute a glove that provides sufficient light in front of the wearer to enable him or her to see his or her path in conditions with minimal ambient light while simultaneously not restricting the wearer's hands and/or fingers and including adaptability for various accessories or carrying relatively small items and safety features (alarms, et al.). Illuminated gloves of the preferred invention replace clunky and uncomfortable head lamps, light-up vests, clip-on lights, and other handheld lights that limit the use of your hands.

BRIEF SUMMARY OF THE INVENTION

Briefly stated, a preferred embodiment of the present invention is directed to a digitally configured glove having light sources, preferably light-emitting diodes ("LED"), housed within a housing mounted to the back portion of the glove. The light sources are configured to illuminate a sufficient distance in front of the wearer to enable him or her to see a path or other running surface when ambient light is low.

In another preferred embodiment, the present invention is directed to an illuminated glove assembly for providing illumination to a user. The illuminated glove assembly includes a glove having a hand portion with a first pocket and an illumination data controller for selective mounting in the first pocket. The hand portion includes a back portion, fingers, a wrist end and a palm portion. The back portion includes the first pocket, which has a first opening proximate the fingers and a first terminal end proximate the wrist end. The illumination data unit includes a housing with a front face, a top surface, a length, a width and a thickness. The front face includes a lens from which light emanates. The width of the illumination data controller is greater than the thickness.

In an additional preferred embodiment, the present invention is directed to an illuminated glove assembly for providing illumination to a user. The illuminated glove assembly includes a glove having a hand portion with a back portion having a connection mechanism, fingers and a thumb and an illumination data controller configured for selective mounting to the glove via the connection mechanism. The hand portion also includes a wrist end and a palm portion. The illumination data controller has a housing with a front face, a top surface, a control button on the top surface, a length, a width and a thickness. The front face includes an arcuate lens from which light emanates. A plurality of light emitting diodes is positioned within the housing to project light out of the arcuate lens.

BRIEF DESCRIPTION OF THE SEVERAL VIEWS OF THE DRAWINGS

The foregoing summary, as well as the following detailed description of the preferred invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
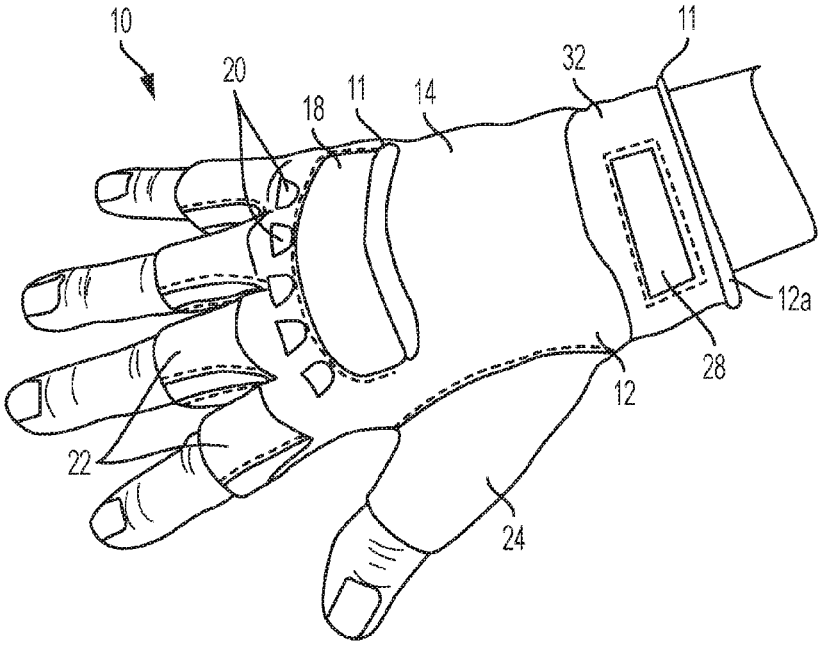
FIG. 1 is a top plan view of an illuminated right-handed glove in accordance with a first preferred embodiment of the present invention, wherein the glove is positioned on a user's/runner's hand.

Certain terminology is used in the following description for convenience only and is not limiting. Unless specifically set forth herein, the terms "a", "an", and "the" are not limited to one element but instead should be read as meaning "at least one." The words "right", "left", "lower", and "upper" designate directions in the drawings to which reference is made. The words "inwardly" or "distally" and "outwardly" or "proximally" refer to directions toward and away from, respectively, the geometric center or orientation of the device and related parts thereof. The terminology includes the above-listed words, derivatives thereof and words of similar import.

It should also be understood that the terms "about," "approximately," "generally," "substantially" and like terms, used herein when referring to a dimension or characteristic of a component of the invention, indicate that the described dimension/characteristic is not a strict boundary or parameter and does not exclude minor variations therefrom that are functionally the same or similar, as would be understood by one having ordinary skill in the art. At a minimum, such references that include a numerical parameter would include variations that, using mathematical and industrial principles accepted in the art (e.g., rounding, measurement or other systematic errors, manufacturing tolerances, etc.), would not vary the least significant digit.

Figure 2:
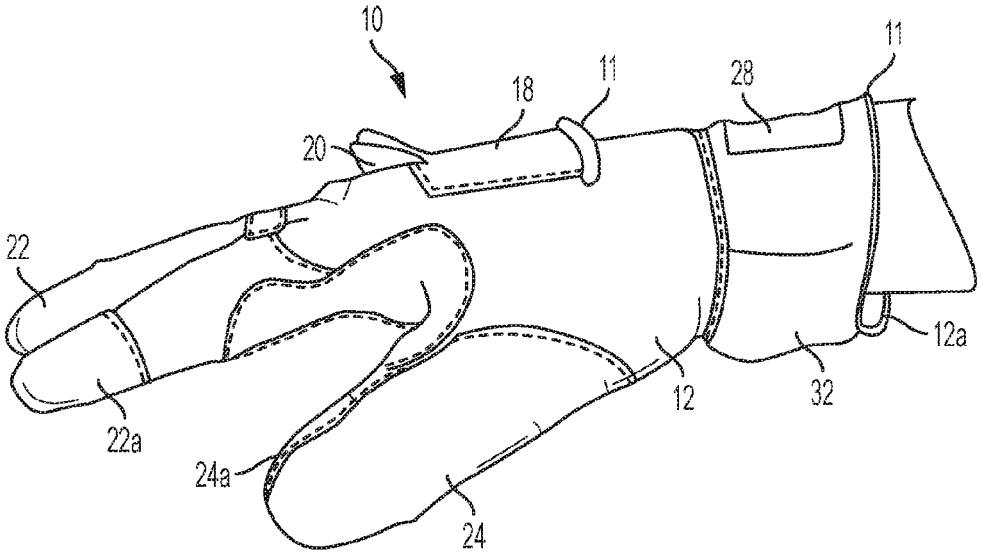
FIG. 2 is a side perspective view of the illuminated glove of FIG. 1.
Figure 3:
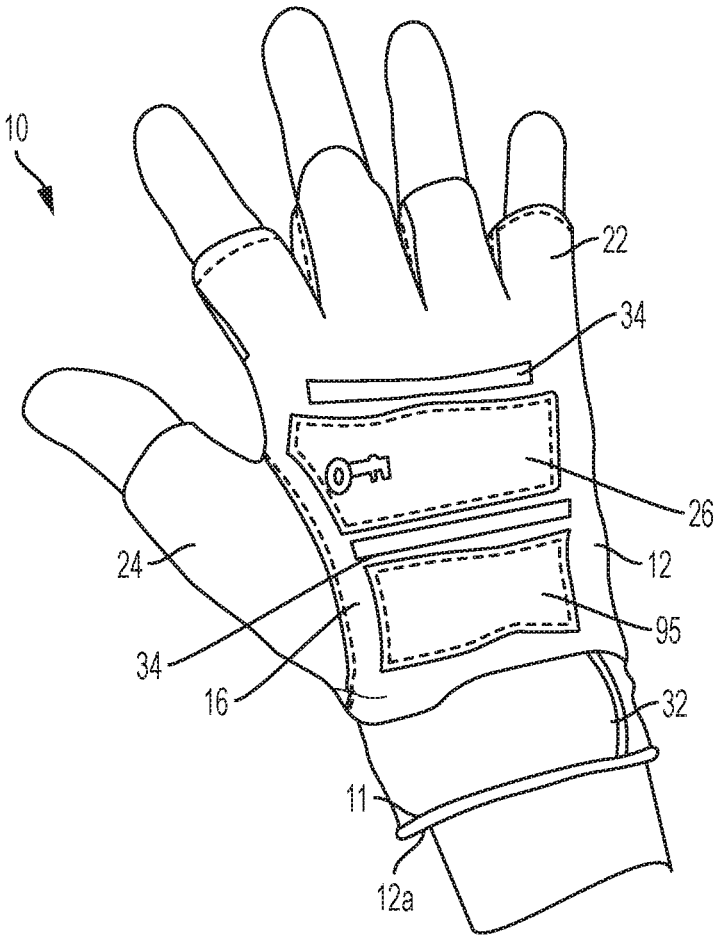
FIG. 3 is a bottom plan view of the illuminated glove of FIG. 1, but is a left-handed version of the preferred glove.
Figure 4A:
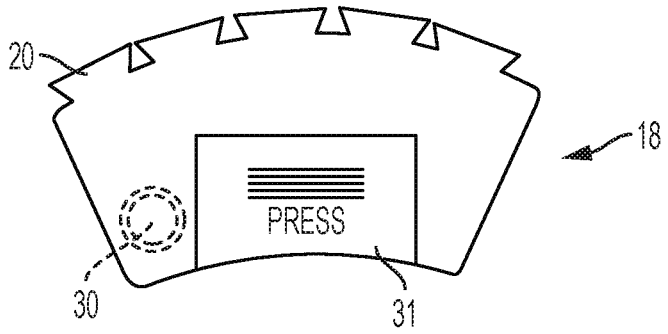
FIG. 4A is a bottom plan view of an illumination data controller for the illuminated glove of FIG. 1.
Figure 4B:
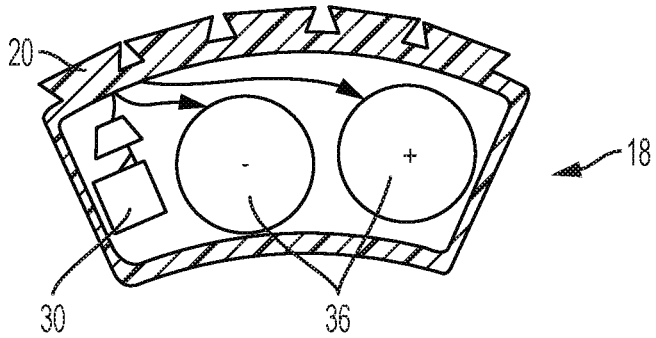
FIG. 4B is a cross-sectional view of the illumination data controller of FIG. 4A, taken on a plane parallel to the bottom plan view of FIG. 4A.
Figure 5:
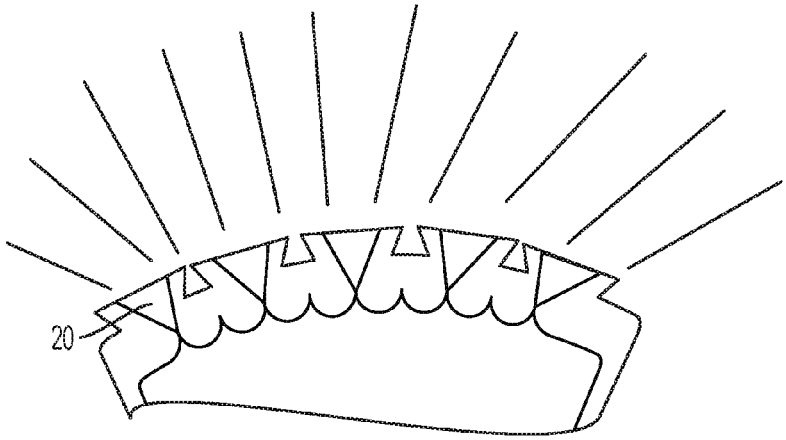
FIG. 5 is a top plan view of a first preferred lens of the illumination data controller of FIG. 4A.

Referring to FIGS. 1-3, an illuminated glove 10 in accordance with a first preferred embodiment is used to illuminate a runner's path while the available ambient light is low. One skilled in the art will appreciate that the illuminated glove 10 is not limited to use while running, but is also useful for any activity wherein the wearer requires artificial lighting to supplement low ambient light. The illuminated glove 10 may be employed by any user who desires lighting while wearing the gloves 10, such as cyclists, athletes, outdoorsmen, survivalists, everyday users and other similar users. The illuminated glove 10 preferably includes a hand portion 12, which further includes a back portion 14 and a palm portion 16. The back portion 14 preferably includes a housing 18 integrally mounted thereto. The housing 18 further preferably including at least two light sources 20. The light sources 20 are preferably configured to cast light at least ten feet (10') in front of the wearer and are preferably comprised light emitting diodes ("LED"). The light sources 20 are not limited to being comprised of LEDs and may be comprised of nearly any lighting component that is able to take on the general size and shape of the light sources 20, withstand the normal operating conditions of the light sources 20 and illuminate an area around the user during operation. The light sources 20 can also be configured to activate in a blinking or flashing pattern to improve the wearer's ability to be seen. It will be understood by one skilled in the art that the light sources 20 are not necessarily LEDs, but can be any device capable of producing sufficient light in front of the wearer to illuminate his or her path, such as incandescent, fluorescent, or halogen light bulbs, illuminating chemicals contained in a housing and the like.

The light sources 20 are not limited to being integrally mounted to the back portion 14 and may be mounted in other portions of the glove 10 or may be otherwise secured to the glove 10. For example, the housing 18 may be comprised of a pocket into which the light sources 20 are mounted for use. The housing 18 and light sources 20 may comprise an illumination data controller that is, as described, separate from the glove 10 and may be removed from the glove 10 for washing, use of the glove 10 without the light sources 20, replacement of the battery 36 or for other like reasons. In the first preferred embodiment, the housing 18 includes a removable door 31 that is selectively removably from the housing 18 to expose the battery 36. The battery 36 is preferably, removably mountable proximate the removable door 31, such as beneath the door 31 and the door 31 may be configured to urge the battery 36 into a mounted configuration to ensure electrical connection with the electronics components in the housing 18. The door 31 may also be comprised of hinged door the is connected to the housing 18 and generally does not fall away from the housing 18, but is retained on the housing 18 when the user opens the door 31 via the hinge mechanism. The hinged door 31 configuration is preferred in certain embodiments to prevent loss of the door 31 when the user removes the door to replace the battery 36 or otherwise removes or opens the door 31.

The illuminated glove 10 of the first preferred embodiment is preferably constructed of any breathable, soft, and flexible material that provides sufficient durability for the wearer to machine wash the glove 10 numerous times after use, such as polyester, nylon, spandex, cotton, any combination thereof or any related material that is able to take on the general size and shape of the glove 10 and withstand the normal operating conditions of the glove 10. One skilled in the art will appreciate that the material of construction will not be limited to polyester, nylon, spandex, cotton, or any combination thereof, but will also include any material suitable for withstanding the normal operating conditions of the illuminated glove 10. The illuminated glove 10 is also preferably constructed of a material capable of being dyed to any number of colors, but is not limited to such dye-able materials.

The palm portion 16 of the illuminated glove 10 preferably includes a padded material, such as foam, but is not so limited. Such padded material should be suitable for improving a wearer's comfort and providing padding or gripping for the palm portion 16. Some of the preferred embodiments of the glove 10 are constructed of the same material in the hand portion 12, the back portion 14 and the palm portion 16 or these portions may be constructed of different materials adapted for the various portions of the preferred illuminated glove 10. The hand portion 12 may be constructed of materials, such as, breathable polyester weave fabric, spandex dri-wicking fabrics, Neoprenes, terry fabrics, suedes, faux suedes, quilting materials, Gore-Tex, fluoropolymer fabrics, vinyl, waterproof fabric, water resistant fabric, CarbonX fabrics, Nomex fabrics, fireproof or fire-resistant fabric, cotton, canvas, heavy canvas and related fabrics and materials that are able to take on or be assembled into the general size and shape of the glove 10 and withstand the normal operating conditions of the glove 10.

The illuminated glove 10 preferably contains a reflective portion, such as a reflective strip 11, to further aid in others' visibility of the wearer, but is not so limited. For example, the reflective strip 11 may be comprised of a reflective portion that is attached to the glove 10, such as by adhesive bonding or stitching, reflective materials incorporated into the materials of the glove 10, such as reflective or glowing dyes, or reflective components that are adhered or otherwise attached to the glove 10. In the first preferred embodiment, the reflective strip 11 is comprised of a reflective trim material that provides a border to the glove 10. The reflective strip 11 may alternatively be positioned on the palm portion 16 or nearly anywhere on the glove 10 to enhance safety for the wearer. For example, the reflective strip 11 of the first preferred embodiment may be attached to a wrist end 12*a* of the hand portion 12 and to a rear end of the housing 18. The reflective strip 11 is not limited to being connected to these listed portions of the glove 10 and may be connected or incorporated into nearly any portion of the glove 10 to provide reflection of light and added safety to a user or wearer.

The illuminated glove 10 also preferably includes finger portions 22 and a thumb portion 24. The finger portions 22 can be of any length, capable of covering only a small portion of the wearer's fingers, such as is shown in FIGS. 1-3, the wearer's fingers in their entirety, or any length in between. In the first preferred embodiment, the fingers 22 of the glove 10 extend approximately to the wearer's first knuckle or completely to the tip of the user's fingers, depending on user preferences. The thumb portions 24 can similarly be of any length. One skilled in the art will appreciate that the illuminated glove 10 can be constructed without the finger portions 22 and/or the thumb portion 24 that extend from the hand portion 12 without deviating from the inventive concept, such as by constructing the glove 10 as a mitten or constructing the glove 10 with holes to accommodate the user's fingers extending out of the glove 10. The glove 10 of the first preferred embodiment does not completely cover the tips of the users or runners fingers such that the user has the ability to touch and feel materials and objects that are grasped and providing at least some exposure for cooling of the fingers.

In the first preferred embodiment, a middle finger of the fingers 22 includes an elongated portion 22*x*. The elongated portion 22*x* is adapted for grasping by the user to facilitate removal of the glove 10 from the user's hand. The glove 10 is not limited to inclusion of the elongated portion 22*x* on the middle finger and may include the elongate portion on any of the other fingers 22, on the thumb 24 or may not include the elongated portion 22*x*. In addition, in full-fingered versions of the glove 10 (FIG. 2), the glove 10 preferably does not include the elongated portion 22*x*.

The fingers 22 are preferably constructed of the same breathable, soft, and flexible materials as any other portion of the illuminated glove 10, but are not so limited. Where the finger 22 are constructed of a sufficient length to cover the wearer's fingertips, the distal ends of the finger portions 22 are preferably also constructed of a conductive material 22*a* that enables the wearer to operate an electronic device, such as a smartphone, tablet, or portable music player, while wearing the illuminated glove 10, but are not so limited. The fingers 22 may be constructed of various materials, such as polar fleece, dri-wicking polyester blends, multiple knits, quilted fabrics or the like, but are not so limited and may be constructed of nearly any material that is able to be constructed into the general size and shape of the fingers 22 and can withstand the normal operating conditions of the glove 10.

The thumb 24 of the illuminated glove 10 is preferably constructed of a cotton terrycloth blend that may be utilized by the user to wipe and absorb sweat from the user's forehead or other areas, but is not so limited. One skilled in the art will appreciate that the thumb 24 is not limited to a cotton terrycloth blend, but may also be constructed of any material suitable for withstanding the normal operating conditions of the invention, such as cotton, polyester, nylon, and the like. The thumb 24 may also be constructed of the same breathable, soft, and flexible material as any other portion of the illuminated glove 10 and various material combinations may be used for the thumb 24 and fingers 22 based on designer or user preferences. The thumb 24 may also include the conductive material 24*a* proximate its tip that enables the user to operate electronic devices, such as smartphones, tablets or portable music players by interaction with a touch screen of these devices while wearing the illuminated glove 10, but are not so limited.

The illuminated glove 10 also preferably includes a second pocket 26 mounted proximate the palm portion 16 of the illuminated glove 10. The second pocket 26 is preferably configured to contain small items a runner or other user may find necessary to carry, such as a key, coins, energy packs, small food items or a replacement battery for the illuminated glove 10. The second pocket 26 is preferably constructed from the same breathable, soft, and flexible material as other portions of the illuminated glove 10, but can also be constructed of any material suitable for withstanding the normal operating conditions of the invention. One skilled in the art will appreciate that the illuminated glove 10 can be constructed without the second pocket 26 without deviating from the inventive concept.

The illuminated glove 10 preferably further includes a window 28 within the back portion 14. The window 28 is preferably located proximate the wrist end 12*a* so that he or she may see through the illuminated glove 10 to view his or her wristwatch, fitness tracker, or other wrist-mounted device without removing or shifting the illuminated glove 10. The window 28 is preferably plastic, polymeric material or vinyl, but can also be any transparent material suitable for withstanding the normal operating conditions of the illuminated glove 10. The window 28 is also preferably constructed in conjunction with an adjustable wrist band or strap 32 so that the wearer may adjust the size of the wrist opening of the illuminated glove 10 while ensuring the illuminated glove 10 is securely affixed to the wearer's hand. The wrist band 32 is preferably an elastic material and is preferably adjustable via a hook and loop material or Velcro strap, but is not so limited. One skilled in the art will appreciate that the wrist band 32 and window 28 may be constructed separately, or one or both may be omitted from the illuminated glove 10 entirely, without deviating from the inventive concept. The window 28 is also not limited to being located proximate the wrist end 12*a* and may be positioned nearly anywhere on the glove 10 for mounting of a fitness tracker, clock, stopwatch or other component or accessory that a user may desire to view while wearing the glove 10.

The housing 18 is preferably removable from the illuminated glove 10 for the purposes of laundering the illuminated glove 10, replacing the batteries (not shown) that power the light sources 20, and the like, but is not so limited. The housing 18 is preferably constructed of any weather-resistant material, such as a polymeric material, but is not so limited. The housing 18 may also be designed and configured to be fixed to the glove 10 so that the glove 10 is washable while the housing 18 is attached thereto.

Referring to FIGS. 1-7, the light sources 20 are preferably mounted within or to the housing 18 and are preferably comprised of approximately five (5) ultra-bright LEDs. One skilled in the art will appreciate that the light sources 20 are not necessarily comprised of LEDs and could be comprised of more or less than five (5) LEDs without deviating from the inventive concept, such as ten (10) LEDs. The LEDs may be comprised of surface mounted display ("SMD") variety LEDs or may be comprised of other varieties of LEDs or chip on board ("COB") SMDs.

The light sources 20 are preferably actuated by a switch 30 on a top of the housing 18, but are not so limited. For example, the light sources 20 may be associated with a sensor that senses ambient light and only illuminates the light sources 20 when the ambient light reaches a predetermined low level. In addition, the light sources 20 may be configured for illumination and/or powering only when the users/runners hands are heated to a predetermined temperature or otherwise reach to a predetermined parameter associated with the user or the user's environment. The switch 30 is preferably a pressure-sensitive button mounted on the housing 18 facing away from the glove 10 for access by the user. One skilled in the art will appreciate that the switch 30 can also be any type of switch suitable for actuating the light sources 20 and can also be mounted anywhere on the illuminated glove 10 suitable for withstanding the normal operating conditions of the preferred invention.

Figure 6:
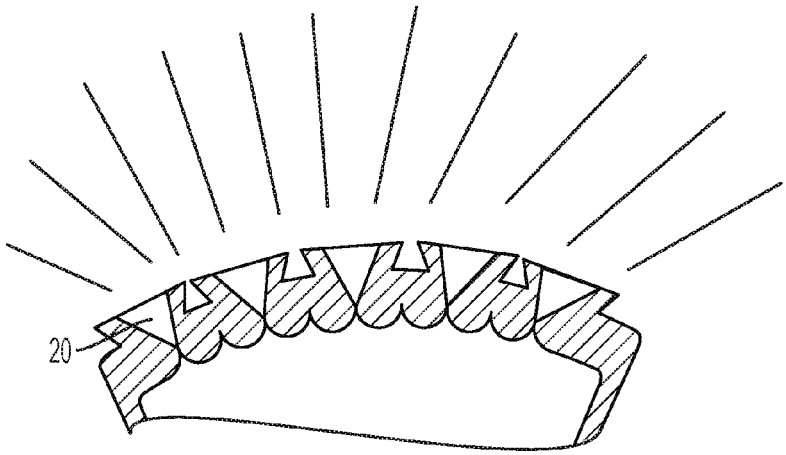
FIG. 6 is a top plan view of a second preferred lens of the illumination of FIG. 4A.
Figure 7:
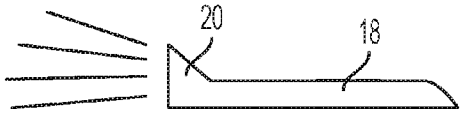
FIG. 7 is a side perspective view of the lens of FIG. 6.

As shown in FIGS. 4-7, the light sources 20 can be arranged in any number of configurations, such as in a parabolic arc (FIGS. 4A and 4B), extending from the housing (FIG. 5), or in a compact line (FIG. 6). One skilled in the art will appreciate that the light sources 20 are not limited to these arrangements and can be configured in many ways to achieve the desired objective. For example, the light sources 20 may have a similar shape to the knuckles of the wearer's hands to project light in nearly any direction in which the wearer directs their knuckles. The light sources 20 may also have an accordion-like shape that are adaptable by a user to direct the light emanating from the light sources 20 in a particular direction, to focus the light from the light sources 20 and/or to disburse the light emanating from the light sources 20. The light sources 20 may be adaptable to changed orientation, intensity, focus and power based on the desires of the user and/or designer. For example, the light sources 20 may be individually or collectively manipulated to direct a light stream sideways from the glove 20, generally outwardly and perpendicularly away from the glove 10, toward the wearer's fingers, toward the wearers arm or in nearly any direction desired by the wearer and/or the designer. Further, the light sources 20 may be designed such that each individual light may direct its light in nearly any desired direction or the plurality of light sources 20 may be arranged such that manipulation of one of the lights impacts the direction, intensity, focus, dispersion and the like of each of the lights 20. The lights 20 are also not limited to being comprised of lights and may be comprised of reflectors that reflect light that shines on the reflectors to alert others of the presence of the wearer of the glove 10.

As shown in FIG. 3, the palm portion 16 of the illuminated glove 10 also preferably includes an anchoring strap 34 useful for securing a personal protectant device such as mace or pepper spray. The anchoring strap 34 is preferably arranged on the palm portion 16 such that the personal protectant device is easily accessible in the event that the wearer encounters danger while exercising. In the first preferred embodiment, the glove 10 includes two individual anchoring straps 34 mounted to the palm portion 16 that facilitate securing of the personal protectant device or nearly any relatively small item in the user's palm. The user is preferably able to place the small item, such as the personal protectant device between the anchoring straps 34 and the palm portion 16 so secure the small item in the user's palm during use. In the first preferred embodiment, the anchoring straps 34 are constructed of an elastic material, but are not so limited and may be constructed of nearly any material or mechanism that is adaptable to securing a small item to the palm portion 16 and is able to withstand the normal operating conditions of the illuminated glove 10.

The preferred glove 10 may also include a controller (not shown) associated with the lights 20 that permits a user or automatically controls features of the lights, such as color, intensity, focus, blinking, sequenced illumination or like features. For example, the controller may permit a wearer to prompt intensity or blinking of the lights 20 or rapidly change colors of the lights 20 to draw attention in a perceived emergency situation, such as danger encountered on a remote running trail or on a night walk through a college campus. Such blinking or modification of the plurality of lights 20 provides a safety feature for the wearer to warn a potential attacker or safety personnel.

The palm portion 16 of the first preferred glove 10 also preferably includes a third pocket 95 that may be utilized to receive an illumination data controller 160, 160', 160", as is described in greater detail below. The illumination data controller 160, 160', 160" can be selectively positioned in the third pocket 95 to illuminate the palm or inner portion of the user's fingers for low light illumination of this area and manipulation of items in the palm or with the user's fingers.

In addition, the controller may permit wireless communication with safety personnel as the result of the wearer activating transmission of a wireless signal from the controller to safety personnel. The strap 34 is not limited to affixing a personal protectant device, but may be used for storing any small item the wearer may wish to access while using the illuminated glove 10. The strap 34 is preferably a hook and loop material or Velcro strap, but is not so limited and may be constructed of any material suitable for withstanding the operating conditions of the invention, such as elastic and the like. One skilled in the art will appreciate that the strap 34 is not limited to a particular location on the palm portion 16, but may be arranged in any position on the illuminated glove 10 useful for affixing a small item without deviating from the inventive concept. In addition, the strap 34 may be comprised of a user actuatable pocket that is integrally formed with the glove 10 that may be actuated by the user when desired to perform a predetermined function, such as spraying mace, providing liquid hydration for the runner, providing an energy formula to the runner or for otherwise storing a material that may be accessed by the user during a desired situation.

The light sources 20 may be powered by any power source 36 suitable for powering the light sources 20. In the first preferred embodiment, the power source 36 is preferably comprised of a small battery 36 such as a button cell or a lithium cell battery 36, a 2032 coin cell battery, a lithium ion rechargeable battery or nearly any other variety of battery that is able to fit into the housing 18, with stand the normal operating conditions of the glove 10 and perform the functions of the battery. The power source 36 is preferably stored in the housing 18, but one skilled in the art will appreciate that the power source 36 may be arranged anywhere on the illuminated glove 10 without defeating the inventive concept. In an alternate embodiment, the power source 36 is a rechargeable battery linked to a solar cell (not shown) mounted on the illuminated glove 10 such that the solar cell is capable of recharging the power source 36. In addition, the power source 36 may be comprised of a conversion component or thermoelectric generator that converts heat generated by the wearer, such as the runner, into electrical power to illuminate the light sources 20 during use. The conversion component is not limited to converting heat generated by a runner and may use the heat generated by any wearer or user of the glove 10. The power source 36 is no limited to being comprised of the battery 36 or conversion component, but may also be comprised of a piezoelectric power source, an alternative solar power source or nearly any other variety of power source 36 that is designed and configured to provide power to the plurality of light sources 20 to illuminate the light sources 20.

In yet another embodiment, the power source 36 may be comprised of a piezoelectric device which provides power to the light sources 20 via the vibrations and stresses created by the wearer's use of the glove 10 in activities such as running, bicycling, hiking, walking, working and the like. When configured as a piezoelectric device, the power source 36 is additionally capable of providing addition feedback to the wearer, conveying such information as distance run, time worn, the speed of the wearer's movement, and the like, through such methods as changing the color of the light sources 20, changing the blinking pattern of the light sources 20, providing a vibratory sensation, providing a display associated with a controller to display various performance features or other mechanisms to alert the user to predetermined performance characteristics.

Figure 8:
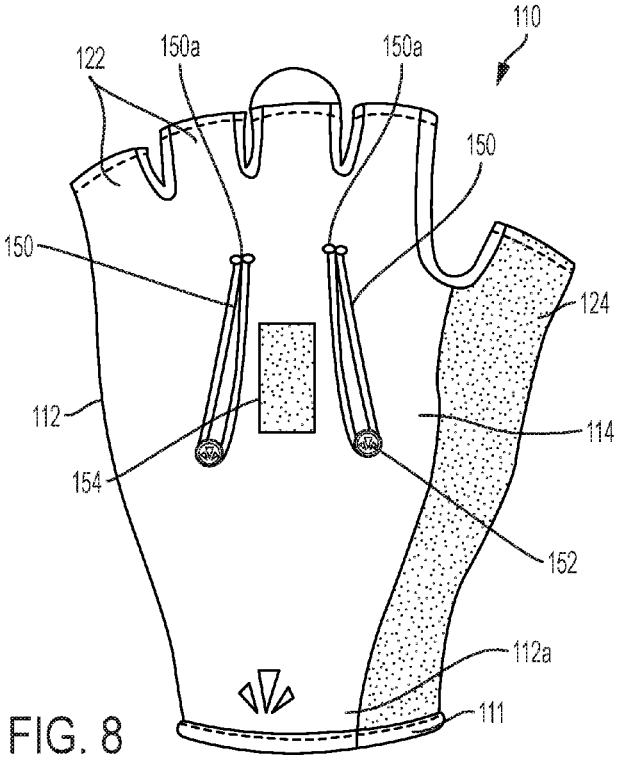
FIG. 8 is a top plan view of a glove in accordance with a second preferred embodiment of the present invention.
Figure 9:
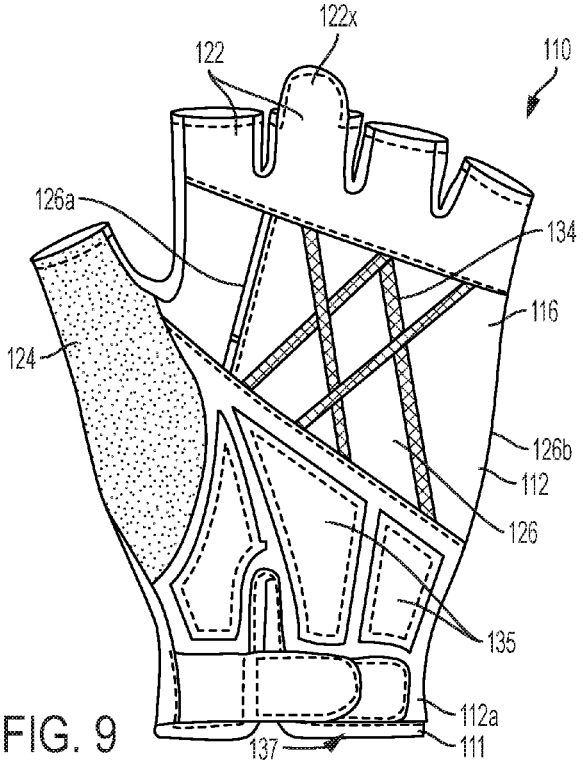
FIG. 9 is a bottom plan view of the glove of FIG. 8.

Referring to FIGS. 8 and 9, a second preferred embodiment of the glove 110 includes similar features and construction when compared to the first preferred embodiment of the glove 10. The same reference numerals are utilized to identify similar features of the second preferred embodiment when compared to the first preferred embodiment with a "1" prefix to distinguish the second preferred embodiment of the glove 110 from the first preferred embodiment of the glove 10.

Referring to FIGS. 8, 9, 12 and 13, the glove 110 of the second preferred embodiment includes a crisscross pattern of straps 134 on the palm portion 116 for securing a small item in the user's palm. The small item may be a personal protection device, key, key fob, card, credit card, currency, energy packs or nearly any other relatively small item, some additional items which were described above, that is able to fit into the users palm and between the palm portion 116 and the straps 134. The straps 134 may be constructed of or coated with a reflective material to act in a manner similar to the reflective strip 11. The glove 110 of the second preferred embodiment is not limited to inclusion of the straps 134 and may be constructed and configured without the straps 134 or may be constructed with an alternative securing mechanism for small items, such as a clamp, clip, hook and loop material, fastener, adhesive material or other small item securing mechanisms.

The palm portion 116 of the second preferred embodiment also preferably includes padded portions 135. The padded portions 135 provide padding in the palm portion 116 for user comfort and for gripping purposes. The palm portion 116 is not limited to inclusion of the padded portions 135 and may be constructed without the padded portions 135 or with padded portions 135 having a different size and configuration than the padded portions 135 shown in the second preferred embodiment.

In the second preferred embodiment, a wrist strap 137 is connected to the wrist end 112*a* of the glove 110. The wrist strap 137 is preferably comprised of a strap with hook and loop material that connects to complementary hook and loop material at the wrist end 112*a* to fasten and secure the glove 110 to the user's hand. The glove 110 is not limited to inclusion of the wrist strap 137 or the wrist strap 137 including hook and loop material. For example, the wrist strap 137 may be comprised of an elastic material that tightens around the user's wrist or includes alternative mechanisms or systems that assist in securing the glove 110 to the user's hand.

The glove 110 of the second preferred embodiment also preferably includes the second pocket 126 beneath the straps 134. The second pocket 126 preferably includes a second opening 126*a* proximate the thumb 124 and a second terminal end 126*b* proximate a side of the hand portion 112 opposite the thumb 124. The second opening 126*a* is preferably secured in a closed configuration with hook and loop material at the second opening 126*a* to secure small items within the second pocket 126. The second pocket 126 is not limited to inclusion of the hook and loop material at the second opening 126*a* and may be otherwise configured to secure the second opening 126*a* in a closed configuration, such as a zipper, button and hole, adhesive material, fastener, clip or other securing mechanism that generally selectively closes the second opening 126*a* to secure the item therein an a closed configuration and allows the user to open the second opening 126*a* for removal of the item. Alternatively, the second opening 126*a* may be consistently left open without a securing mechanism, such as, if the material of the palm portion 116 and the second pocket 126 are configured to at least loosely secure the item therein, such as with relatively elastic material constructions of the glove 110. The second pocket 126 of the second preferred embodiment preferably extends to the terminal end 126*b* opposite the second opening 126*a* and, therefore, extends substantially across the palm portion 116. The second pocket 126 is not limited to having the depicted size and/or shape and may be smaller or larger depending on user or designers preferences.

The glove 110 of the second preferred embodiment also includes a pair of anchoring straps 150 mounted to the back portion 114 with corresponding hooks 152. The anchoring straps 150 are preferably fixed or secured at a first end 150*a* to the back portion 114 and form substantially endless loops that may be selectively connected to the hooks 152. A secondary securing mechanism 154 is also preferably positioned on the back portion 114 between the anchoring straps 150, but is not so limited and the glove 110 may function without inclusion of the secondary securing mechanism 154. The anchoring straps 150 are preferably constructed of an elastic or partially elastic material that may be stretched to engage the hooks 152 to apply tension to the anchoring straps 150 for securing nearly any item between the straps 150 and the back portion 114, such as keys, a key fob, personal protection device, writing instrument or nearly any other relatively small personal item. The secondary securing mechanism 154 is preferably a hook and loop material, but is not so limited and may be constructed of nearly any fastening or securing mechanism that is able to engage a light projecting mechanism, as is described in greater detail below.

Figure 12:
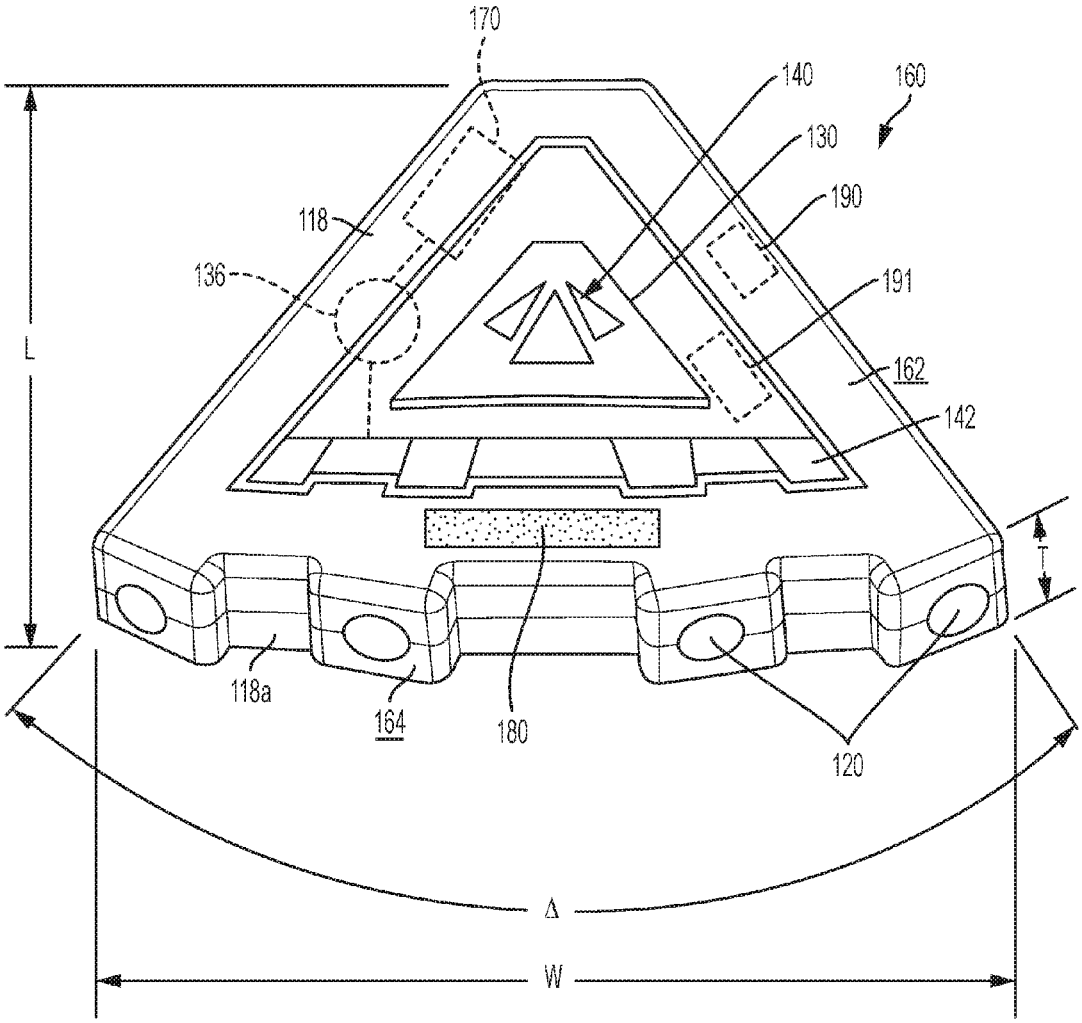
FIG. 12 is a front perspective view of an illumination data controller in accordance with a first preferred embodiment of the present invention that may be utilized with the any of the preferred gloves of the present invention.

In the second preferred embodiment, the anchoring straps 150 are particularly adapted for securing an illumination data controller 160, 160' to the glove 110. The illumination data controller 160, 160' is the same or similar to the housing 18 and light sources 20 of the glove 10 of the first preferred embodiment. The illumination data controller 160, 160' includes a housing 118, 118' with a front face 118*a*, 118*a*' a top surface 162, 162' a length L, L' a width W, W' and a thickness T, T'. First and second preferred illumination data controllers 160, 160' are shown in FIGS. 12 and 13, with a prime symbol "'" being utilized to distinguish the illumination data controller 160 of the first preferred embodiment from the illumination data controller 160' of the second preferred embodiment. The illumination data controllers 160, 160' are adapted for use with the preferred gloves 10, 110, 210, as is described herein and will be described in further detail below. The illumination data controllers 160, 160', 160" are preferably self-contained such that they do not include or require wires extending therefrom to power or control the units 160, 160', 160". Accordingly, the user is able to generally move about freely with the preferred illuminated glove assemblies.

The first and second preferred embodiments of the illumination data controllers 160, 160' preferably include a front face 164, 164' from which light emanates from the light source 120, 120'. The light sources 120, 120' are preferably comprised of LED's, but are not so limited and may be comprised of nearly any source of light that is able to project light from the front face 164, 164' to illuminate an area in front of the front face 164, 164'. The front face 164, 164' and the light source 120, 120' may be configured to project light from the illumination data controllers 160, 160' over a variable angle, depending on user and designer preferences. For example, in the second preferred embodiment, the illumination data controller 160' is configured to project light from the front face 164'over an arc Δ' of at least two hundred thirty-five degrees) (235°), while the front face 164 of the first preferred embodiment of the illumination data controller 160 is configured to project light over an arc of slightly more than ninety degrees) (90°). The arc Δ, Δ' of lateral light projection from the front faces 164, 164' is not limited to these described configurations and may be arranged and configured to laterally project light over alternative ranges, as desired by the user or designer and may also be configured to change the arc Δ, Δ' dynamically via controls in or on the housing 18, 118, 118' to widen, focus, alter or otherwise change the orientation of the light emanating from the light sources 120, 120'. The first preferred illumination data controller 160 includes four (4) light sources 120, preferably LEDs, and the second preferred illumination data controller 160' includes six (6) light sources 120', preferably LEDs, but the illumination data controllers 160, 160' are not limited to the specifically shown number of lights sources 120, 120' and may have alternate numbers of LEDs or may be otherwise configured with alternative lighting mechanisms.

Referring to FIGS. 8 and 12-13B, both of the illumination data controllers 160, 160' of the first and second preferred embodiments are adapted for selective mounting to the back portion 114 of the glove 110 of the second preferred embodiment. The illumination data controllers 160, 160' are preferably attached to the secondary securing mechanism 154 of the glove 110 through the lower securing mechanism 166'. The light anchoring straps 150, 150' are wrapped over the top surface 162, 162' of the illumination data controller 160, 160' and the ends are secured to the hooks 152. The illumination data controllers 160, 160' are arranged with the front faces 164, 164' positioned proximate the fingers 122 such that the light extends outwardly and away from the user knuckles during use. The light is preferably activated by depressing a control button or switch 130, 130' on the top surface 162, 162'. The illumination data controller 160, 160' is preferably, thereby held on the glove 110 during activity.

Following the activity or generally to remove the illumination data controllers 160, 160' from the glove 110, the anchoring straps 150, 150' are detached from the hooks 152 and the secondary securing mechanism 154 is removed from the lower securing mechanism 166'. A different illumination data controller may then be likewise mounted to the glove 110, the battery 36 may be replaced, the glove 110 may be washed or other similar actions may be taken.

Figure 10A:
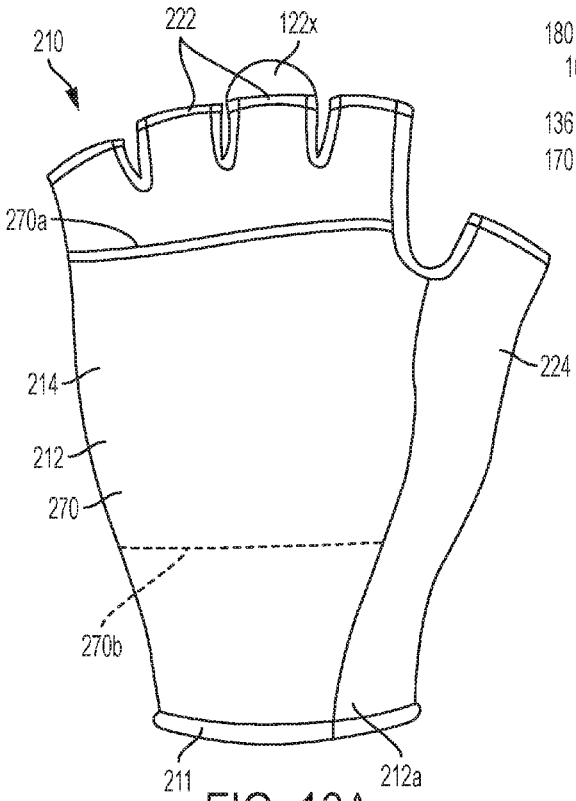
FIG. 10A is a top plan view of a glove in accordance with a third preferred embodiment of the present invention that may be utilized with any of the preferred gloves of the present invention.
Figure 10B:
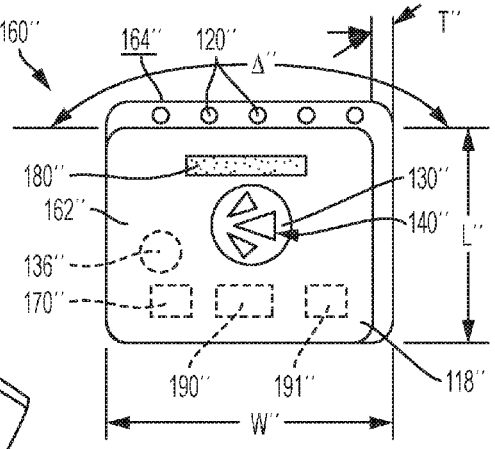
FIG. 10B is a top perspective view of an illumination data controller in accordance with a third preferred embodiment of the present invention.
Figure 11:
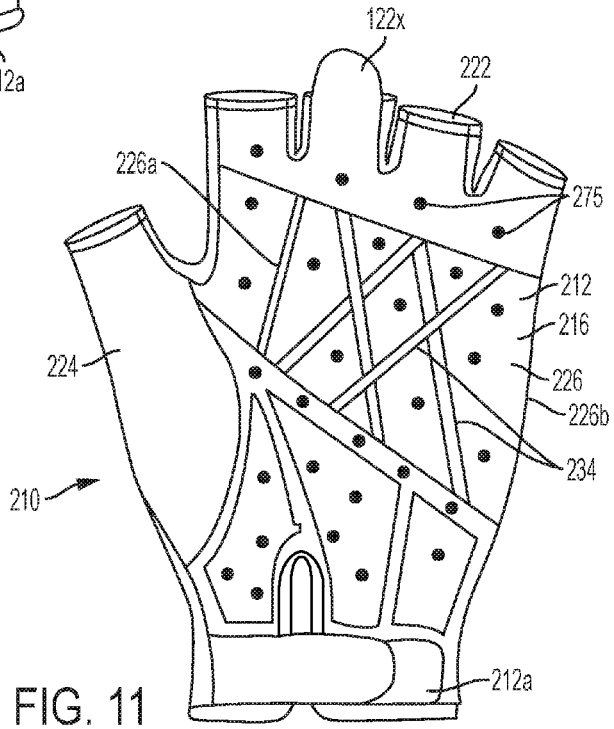
FIG. 11 is a bottom plan view of the glove of FIG. 10.

Referring to FIGS. 10A-11, a third preferred embodiment of the glove 210 includes similar features and construction when compared to the first and second preferred embodiments of the glove 10, 110. The same reference numerals are utilized to identify similar features of the third preferred embodiment when compared to the first and second preferred embodiments with a "2" prefix to distinguish the third preferred embodiment of the glove 210 from the first and second preferred embodiments of the glove 10, 110.

In the first preferred embodiment, the illumination data controller 160 includes a solar panel or solar cell 142 on its top surface 162. The solar panel 142 is preferably able to collect solar energy for charging or re-charging the battery 136. The solar panel 142 may be comprised of a crystalline solar panel 142 or nearly any solar panel or array that is able to collect solar energy and convert the solar energy to electrical energy to power the illumination data controller 160.

The third preferred embodiment of the glove 210 is also adapted for use with a third preferred embodiment of the illumination data controller 160". The third preferred embodiment of the illumination data controller 160" includes similar features and construction when compared to the first and second preferred embodiments of the illumination data controller 160, 160'. The same reference numerals are utilized to identify similar features of the third preferred embodiment when compared to the first and second preferred embodiments with a double-prime "'" symbol utilized to distinguish the third preferred embodiment of the illumination data controller 160" from the first and second preferred embodiments of the illumination data controller 160, 160'.

The glove 210 of the third preferred embodiment includes a first pocket 270 in the back portion 214. The first pocket 270 includes a first opening 270*a* proximate the fingers 222 and a first terminal end 270*b* proximate the wrist end 212*a*. The first pocket 270 is preferably formed between the first opening 270*a* and the first terminal end 270*b* between portions of fabric of the back portion 214, but is not so limited and may be otherwise formed by separate material from the glove 210 or otherwise, as long as a first pocket 270 is formed and attached to the glove 210 for receipt of one of the illumination data controllers 160, 160', 160". In addition, the first pocket 270 is not limited to being positioned on the back portion 214 and may be alternatively mounted on the palm portion 216 for receipt of the illumination data controllers 160, 160', 160" to project light onto the inner-fingertips of the user or wearer. Illuminating the fingertips of the user may be desirable for users performing relatively fine tasks proximate the fingertips, such as a fisherman threading fishing line into the eye of a fishing hook in dark or low light conditions.

The first opening 270*a* is preferably selectively opened and closed utilizing hook and loop material positioned along the internal edge of the first opening 270*a*, but is not so limited. The first opening 270*a* may be otherwise selectively opened or closed using a zipper, clamp, button and hole, adhesive material or other selective fastening or securing device that is able to substantially secure the illumination data controllers 160, 160', 160" in the first pocket 270*a*, as is described in further detail below. The first opening 270*a* is also not limited to inclusion of a securing device or mechanism and may be constructed of a constantly open first opening 270*a* with only the material of the glove 10 forming the first opening 270*a*, preferably with the material having elasticity to hold the illumination data controllers 160, 160', 160" within the first pocket 270.

In the preferred embodiments, the hook and loop material at the first opening 270*a* interacts with an engagement mechanism 180, 180', 180" on the top surfaces 162, 162', 162" and bottom surfaces 163' of the illumination data controllers 160, 160', 160" to assist with securing the illumination data controllers 160, 160', 160" in the first pocket 270. The bottom surfaces 163' may be constructed of a resilient material or have a resilient material, such as silicone, coated thereon to improve comfort for the user. The rear portion of the housings 118, 118', 118" are preferably slid into the first pocket 270 at least until the engagement mechanism 180, 180', 180" contacts and is secured to the hook and loop material at the first opening 270*a* with the light sources 120, 120', 120" positioned outside of the first pocket 270. This mounted configuration assists in securing the illumination data controllers 160, 160', 160" to the glove 210 and positions the lights sources 120, 120', 120" to direct light over the user's knuckles. The illumination data controllers 160, 160', 160" are not limited to having the engagement mechanism 180, 180', 180", to hook and loop material or to the specific placement of the engagement mechanism 180, 180', 180", but the glove 210 preferably includes accommodation of some feature that orients the light sources 120, 120', 120" relative to the glove 210 and secures the engagement mechanism 180, 180', 180" to the glove 210.

In the preferred embodiments, the length L, L', L" and width W, W', W" of the illumination data controllers 160, 160', 160" are measured at the maximum length and width of the preferred illumination data controllers 160, 160', 160". The width W, W', W" of the preferred embodiments is greater than the length L, L', L", which is in turn greater than the thickness T, T', T". Such a design of the preferred illumination data controllers 160, 160', 160" results in a relatively compact design and generally maximizes the front face 164, 164', 164" for significant illumination across and beyond the user's knuckles. The illumination data controllers 160, 160', 160" are not so limited and may be otherwise designed and configured based on user and designer desires or for particular varieties of design considerations.

Referring to FIG. 10B, in the second preferred embodiment, the illumination data controller 160" has a width W" of approximately one and three-quarters (1¾), a length of one and one-half inches (1½) and a thickness of one-half inch (½). The illumination data controller 160" is not limited to these preferred dimensions and may be otherwise sized and configured for mounting to the gloves 10, 110, 210, for projecting a preferred amount of light from the front face 164, 164', 164' and for otherwise performing the preferred functions of the illumination data controller 160".

Figure 13B:
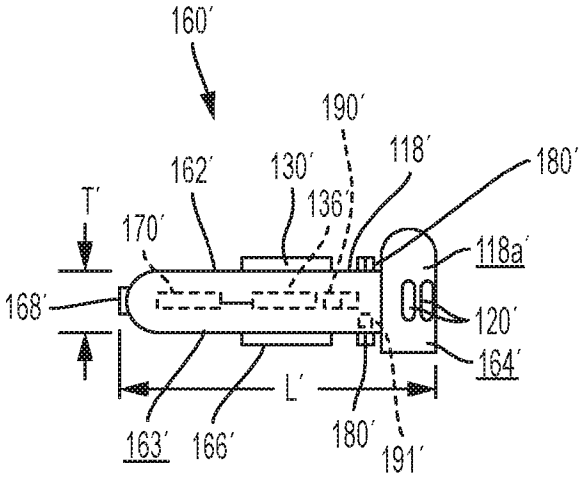
FIG. 13B is a side elevational view of the illumination data controller of FIG. 13A.
Figure 13A:
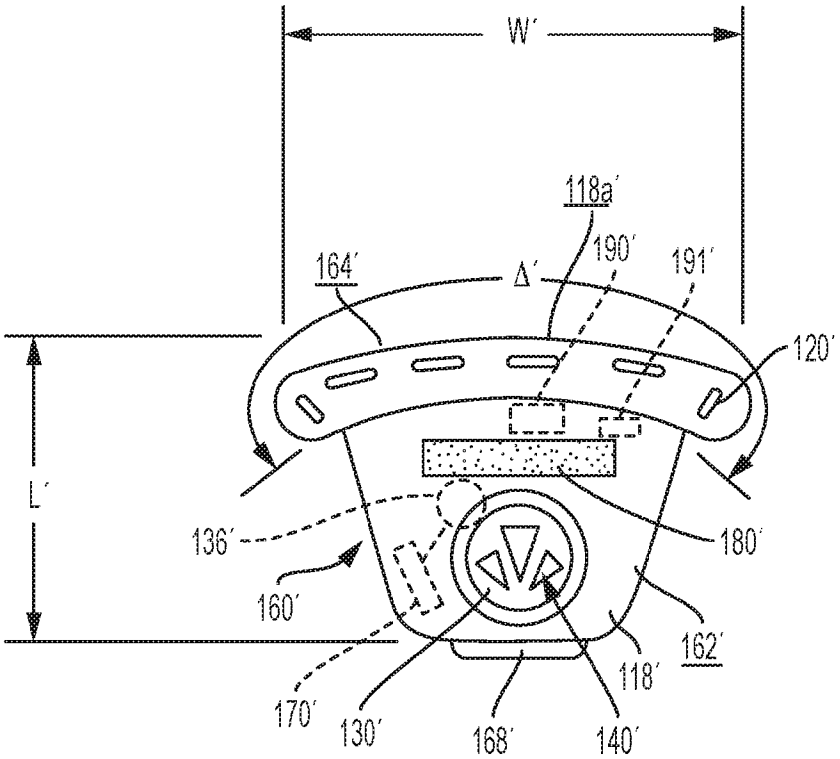
FIG. 13A is a top plan view of an illumination data controller in accordance with a second preferred embodiment of the present invention that may be utilized with any of the preferred gloves of the present invention.

Referring to FIGS. 13A and 13B, in the second preferred embodiment of the illumination data controller 160', an electrical connection port 168' is positioned at a rear of the housing 118'. The electrical connection port 168' may be utilized for recharging the battery 36, to load information into a processor for programming functions related to the illumination data controllers 120', for collecting data sensed by sensors in the housing 118' or for other connection purposes. The electrical connection port 168' may be comprised of a universal serial bus ("USB") port or other connection port for communication with the illumination data controller 160' and its features and components. The illumination data controller 160' of the second preferred embodiment is not limited to inclusion of the electrical connection port 168' or to inclusion of only one electrical connection port 168' and may include none or multiple electrical connection ports 168'. In addition, the first and third preferred illumination data controllers 160, 160" may likewise include none or more than one electrical connection port 168'.

The preferred illumination data controllers 160, 160', 160" includes a wireless transmitter 170, 170', 170" mounted within the housing 118, 118', 118" that is configured for communication with other wireless receivers and transmitters (not shown) to send and receive data. The preferred illumination data controllers 160, 160', 160" also preferably include alarms and safety features for the wearer. The wireless transmitters 170, 170', 170" are preferably powered by the batteries 136, 136', 136" and may transmit and receive various types and varieties of data to other wireless transmitters and receivers. For example, the wireless transmitter 170, 170', 170" may send an emergency message and location information when prompted by the wearer to alert emergency personnel to enhance the user's safety. The wireless transmitter 170, 170', 170" may also transmit location information and receive direction information for a runner that pre-determines a running route and the illumination data controller 160, 160', 160" may audibly or visually provide direction information to the wearer to follow the predetermined route. The wireless transmitter 170, 170', 170" may also transmit information collected from sensors associated with the transmitter 170, 170', 170" or glove 10, 110, 210 related to physiological properties of the user for performance or health and safety purposes.

In the preferred embodiments, the illumination data controllers 160, 160', 160" include a circuit board 190, 190', 190" and a microchip 191, 191', 191" in communication with the light source 120, 120', 120". The circuit board 190, 190', 190" and the microchip 191, 191', 191" are preferably configured to control operation of the light sources 120, 120', 120" such as to display a blinking or predetermined light show from the light sources 120, 120', 120". The information for the predetermined light shows or other control related to the circuit board 190, 190', 190" and the microchip 191, 191', 191" may be pre-loaded into the illumination data controllers 160, 160', 160", may be sent via the wireless transmitters 170, 170', 170" or may be otherwise communicated.

In operation, the user may place the glove 10, 110, 210 onto their hand with the illumination data controllers 160, 160', 160" already connected thereto or may engage the illumination data controller 160, 160', 160" with the glove 10, 110, 210 after placement on their hand. In the third preferred embodiment, the illumination data controller 160, 160', 160" is urged into the first pocket 270 through the first opening 270*a* at least until the engagement mechanism 180, 180', 180" contacts and engages the hook and loop material or other securing mechanism at the first opening 270*a*. The user may then actuate the light sources 120, 120', 120" by depressing the control button or switch 130, 130', 130". The user may also position relatively small items beneath the straps 234 and in the second pocket 226 on the palm portion 216. The palm portion 216 preferably includes gripping dots 275 thereon to facilitate gripping or grasping of items that are positioned in the user's palm. The circuit board 190, 190', 190" and the microchip 191, 191', 191" may be comprised of a chip mounted on board-variety unit that is located in the housing 118, 118', 118" below the control button 130, 130', 130". The control button 130, 130', 130" preferably includes a symbol 140 thereon comprised of three triangles pointing in a predetermined direction. A corresponding symbol may be located on the glove 10, 110, 210 to indicate to the user the authenticity of the pairing of the glove 10, 110, 210 and the illumination data controller 160, 160', 160" or the expected direction for mounting the illumination data controller 160, 160', 160" on the glove 10, 110, 210. The symbol 140 may be illuminated for user convenience or to indicate the power level or charge of the power source or battery 36, 136, 136', 136". The symbol 140 may also be comprised of a light channel for presenting notifications to the user or wearer.

It will be appreciated by those skilled in the art that changes could be made to the embodiments described above without departing from the broad inventive concept thereof. For example, the various components and features of the first, second and third preferred embodiments of the glove 10 may be mixed and matched or incorporated together as desired by a user or designer. For example, the window 28 of the first preferred embodiment of the glove 10 may be incorporated into the gloves 110, 210 of the second and third preferred embodiments, the first pocket 270 may be includes in the first and second preferred gloves 10, 110, the window 28 may be employed with the second and third preferred gloves 110, 210, any of the preferred gloves 10, 110, 210 may include full or partial fingers 22, the preferred illumination data controllers 160, 160', 160" may be mounted in the first preferred glove 10, the arcuate front face 164' of the second preferred embodiment of the illumination data controller 160' may be utilized with the first and third preferred illumination data controllers 160, 160" and other mixing and matching of the features of the gloves 10, 110, 210 and illumination data controllers 160, 160', 160" may be employed. It is understood, therefore, that this invention is not limited to the particular embodiments disclosed, but it is intended to cover modifications within the spirit and scope of the present invention as defined by the present disclosure.

I claim:

1. An illuminated glove assembly for providing illumination to a user, the illuminated glove assembly comprising:

a glove including a hand portion, the hand portion including a back portion, fingers, a wrist end and a palm portion, the back portion including a first pocket, the first pocket including a first opening proximate the fingers and a first terminal end proximate the wrist end, wherein elastic straps are connected to the palm portion, the elastic straps having reflective material on an external surface; and an illumination data controller configured for selective mounting in the first pocket, the illumination data controller including a housing with a front face, a top surface, a length, a width and a thickness, the front face including a light source from which light emanates, the width being greater than the thickness.

2. The illuminated glove assembly of claim 1, wherein the illumination data controller includes a plurality of light sources configured to project light at a distance of at least ten feet, the light sources housed within the illumination data controller.

3. The illuminated glove assembly of claim 1, wherein the fingers extend from the hand portion approximately to a wearer's first knuckle, the hand portion also including a thumb extending therefrom between the fingers and the wrist end.

4. The illuminated glove assembly of claim 1, wherein the palm portion is constructed of a sheer material and includes a second pocket, the second pocket including a second opening proximate a thumb and a second terminal end proximate a side of the hand portion opposite the thumb.

5. The illuminated glove assembly of claim 1, the glove includes an anchoring strap constructed of an elastic material mounted thereto.

6. The illuminated glove assembly of claim 1, wherein a thumb extends from a side of the back portion and the palm portion, the thumb constructed of a terry cloth absorbent material.

7. The illuminated glove assembly of claim 1, wherein the illumination data controller is self-contained and includes an alarm and a wireless transmitter, the wireless transmitter configured for communication with other wireless receivers and transmitters to send and receive data.

8. The illuminated glove assembly of claim 1, wherein the illumination data controller includes a circuit board and a microchip in communication with the light source, the circuit board and microchip configured to control operation of the light source.

9. The illuminated glove assembly of claim 8, wherein the circuit board and microchip are comprised of a chip mounted on board-variety unit.

10. The illuminated glove assembly of claim 1, wherein the light source is comprised of a series of light emitting diodes.

11. The illuminated glove assembly of claim 10, wherein the light emitting diodes are selected from the group consisting of a surface mounted display variety and a chip on board variety.

12. The illuminated glove assembly of claim 1, wherein the palm portion includes gripping dots configured to facilitate gripping and grasping items.

13. The illuminated glove assembly of claim 1, wherein the hand portion is constructed of a material selected from the group consisting of polyester, spandex, dri-wicking material, polar fleece and combinations thereof.

14. The illuminated glove assembly of claim 1, wherein the palm portion and the fingers are constructed of a synthetic suede material, a middle finger of the fingers includes an elongated portion to facilitate removal of the glove from the user's hand.

15. The illuminated glove assembly of claim 1, wherein the illumination data controller includes a power source and a plurality of light sources, the power source connected to the plurality of light sources to selectively illuminate the plurality of light sources.

16. The illuminated glove assembly of claim 1, wherein the illumination data controller includes a power source, the power source is selected from the group consisting of a piezoelectric power source, a solar power source, a battery, a rechargeable battery and a lithium ion battery.

17. The illuminated glove assembly of claim 1, wherein the glove is constructed at least partially of a material selected from the group consisting of a breathable material, fluoropolymer fabric, vinyl, a waterproof fabric, a lightweight waterproof fabric, Gore-Tex, CarbonX, Nomex, a fireproof fabric, cotton, heavy canvas and a combination of cotton and heavy canvas.

18. An illuminated glove assembly for providing illumination to a user, the illuminated glove assembly comprising:

a glove including a hand portion, the hand portion including a back portion, fingers, a wrist end and a palm portion, the back portion including a first pocket, the first pocket including a first opening proximate the fingers and a first terminal end proximate the wrist end; and an illumination data controller configured for selective mounting in the first pocket, the illumination data controller including a housing with a front face, a top surface, a length, a width and a thickness, the front face including a light source from which light emanates, the width being greater than the thickness, the illumination data controller includes a control button on the top surface, the control button including a symbol thereon, the symbol is comprised of three triangles that may be illuminated, the symbol configured for illumination to indicate the charge or power level of a power source of the illumination data controller.

* * * * *